United States Patent [19]

Denzin et al.

[11] Patent Number: 4,522,121

[45] Date of Patent: Jun. 11, 1985

[54] CHASSIS FOR A FRANKING OR POSTAGE METERING MACHINE

[75] Inventors: Horst Denzin; Horst Päch, both of Berlin, Fed. Rep. of Germany

[73] Assignee: Francotyp Gesellschaft mbH, Berlin, Fed. Rep. of Germany

[21] Appl. No.: 572,594

[22] Filed: Jan. 19, 1984

Related U.S. Application Data

[63] Continuation of Ser. No. 358,872, Mar. 16, 1982, abandoned.

[30] Foreign Application Priority Data

Mar. 23, 1981 [DE] Fed. Rep. of Germany ... 8108924[U]

[51] Int. Cl.[3] ..... B41F 1/26

[52] U.S. Cl. ..... 101/92; 101/327

[58] Field of Search ..... 101/327–329

[56] References Cited

U.S. PATENT DOCUMENTS

| | | | |
|---|---|---|---|
| 1,227,561 | 5/1917 | Aitken | 384/260 |
| 1,909,326 | 5/1933 | Wheeler, Jr. | 101/329 |
| 2,237,228 | 4/1941 | Jobe | 101/328 |
| 2,404,921 | 7/1946 | Oxsen | 384/260 |
| 2,669,926 | 2/1954 | Ford | 101/92 |
| 2,887,047 | 5/1959 | McKay | 101/329 |
| 3,146,707 | 9/1964 | Sloane | 101/329 |
| 3,154,184 | 10/1964 | Gallant et al. | 400/660.2 |
| 3,167,009 | 1/1965 | Sloane | 101/329 |
| 3,364,849 | 1/1968 | Price, Jr. | 101/329 |
| 3,745,920 | 7/1973 | McKay | 101/329 |
| 3,780,669 | 12/1973 | Geiger et al. | 101/375 |
| 4,063,630 | 12/1977 | Crowe et al. | 400/691 |
| 4,084,501 | 4/1978 | Kerwin et al. | 101/92 |
| 4,096,906 | 6/1978 | Bonnamonr | 308/189 R |
| 4,268,177 | 5/1981 | Veale | 400/55 |

FOREIGN PATENT DOCUMENTS

| | | | |
|---|---|---|---|
| 257659 | 9/1926 | United Kingdom | 400/660.2 |

*Primary Examiner*—William Pieprz

*Attorney, Agent, or Firm*—Herbert L. Lerner; Laurence A. Greenberg

[57] ABSTRACT

Chassis for postage metering machines having a printing-cylinder shaft supported by ball bearings, including a base plate, a U-shaped frame carried by the base plate and formed with two similarly shaped legs having holes formed therein for accommodating the ball bearings of the printing-cylinder shaft, a peripheral edge defining the holes being formed with incisions for receiving therein means for adjusting the ball bearings in said holes, pivotable retaining brackets fastened to the legs, and two rods connecting the legs to one another at an open part of the U-shaped frame for mutually bracing the legs.

4 Claims, 2 Drawing Figures

CHASSIS FOR A FRANKING OR POSTAGE METERING MACHINE

Figure 1:
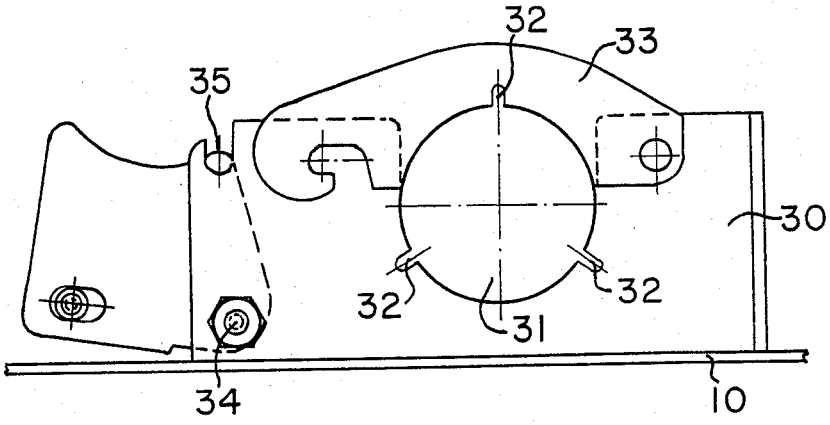

This application is a continuation of application Ser. No. 358,872, filed Mar. 16, 1982 and now abandoned.

The invention relates to a chassis for franking or postage metering machine.

Postage metering or franking machines are composed of many mechanical and electrical structural members. Preferably, holding devices and bearing elements are disposed on the base plate of the machine, the structure members being fastened and guided therein. In addition, suitable formations of the housing walls are utilized for such purposes.

Assembly of such postage metering machines formed of many individual parts requires great expense in time and adjustments.

It is an object of the invention to provide a chassis for a postage metering machine which affords pre-assembly and adjustment of individual subassemblies and thereby simplifies assembly of the machine and, accordingly, requires less economic outlay.

With the foregoing and other objects in view, there is provided, in accordance with the invention, a chassis for postage metering machines having a printing-cylinder shaft supported by ball bearings, comprising a base plate, a U-shaped frame carried by the base plate and formed with two similarly shaped legs having holes formed therein for accommodating the ball bearings of the printing-cylinder shaft, peripheral edge defining the holes being formed with incisions for receiving therein means for adjusting the ball bearings in the holes, pivotable retaining brackets fastened to the legs, and two rods connecting the leg to one another at an open part of the U-shaped frame for mutually bracing the legs.

In accordance with another feature of the invention the plates serving as carrying elements for subassemblies are supported by the rods, spacer sleeves intermediate the plates being coaxially mounted on the rods for fixing the plates in mutually spaced relationship.

In accordance with a further feature of the invention the plates and the subassemblies carried thereby are pivotable in common with respect to the frame about one of the rods.

In accordance with an additional feature of the invention, the other of the rods is removable from the plates so that the plates and the subassemblies carried thereby are individually pivotable with respect to the frame about the one rod.

In accordance with a concomitant feature of the invention the plates are formed with an annular shape at the sides thereof facing into the interior of the frame, in installed position thereof.

Other features which are considered as characteristic for the invention are set forth in the appended claims.

Although the invention is illustrated and described herein as embodied in a chassis for a franking or postage metering machine, it is nevertheless not intended to be limited to the details shown, since various modifications and structural changes may be made therein without departing from the spirit of the invention and within the scope and range of equivalents of the claims.

Figure 2:
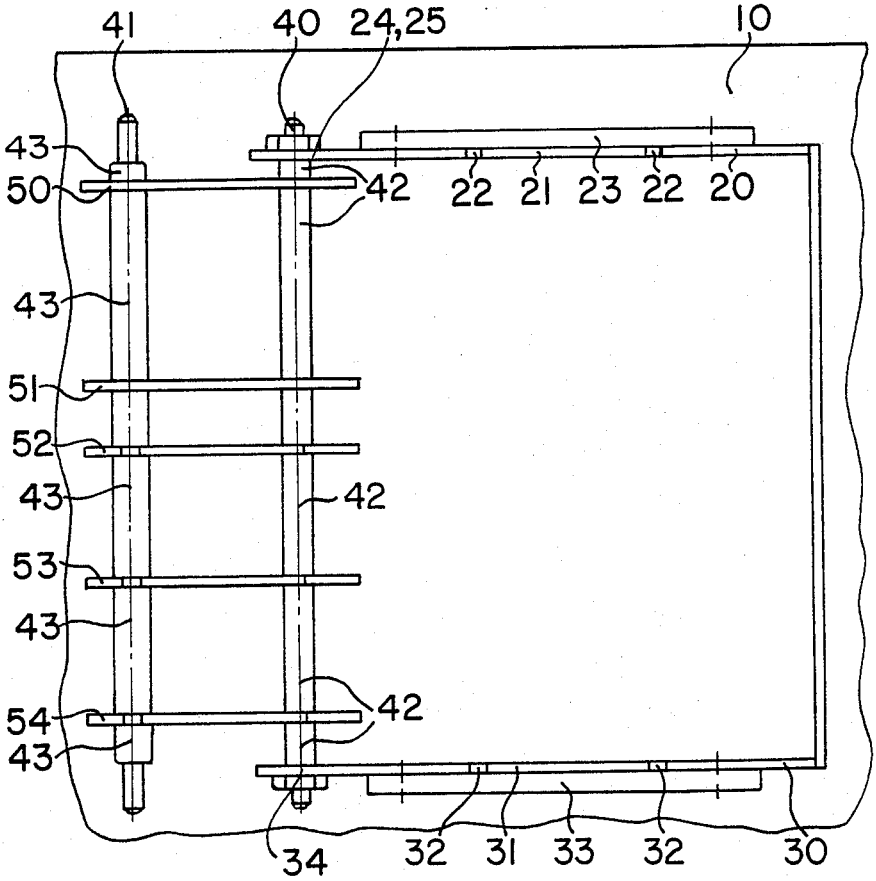

The construction and method of operation of the invention, however, together with additional objects and advantages thereof will be best understood from the following description of specific embodiments when read in connection with the accompanying drawings in which:

FIG. 1 is a side elevational view of the chassis for a postage metering machine; and FIG. 2 is a top plan view of FIG. 1.

The illustrated chassis serves for receiving the printing-cylinder shaft with the printing cylinder, the adjustment members for the printing elements and the control devices for the adjusted printing values.

Referring now specifically to the figures of the drawing, there is shown a chassis for a postage metering machine which is formed of a U-shaped frame placed upon a base plate 10. The base plate 10 has non-illustrated holes or perforations formed therein and additional carrier and fastening elements. The U-shaped frame is formed with similar legs 20 and 30 which are provided with very large holes 21 and 31, respectively, for receiving therein non-illustrated ball bearings of the printing cylinder shaft. A plurality, preferably two, incisions 22 and 32 are formed at the periphery of the large holes 21 and 31 and serve for receiving therein adjustable adjustment means for the non-illustrated ball bearings firmly connected to the printing-cylinder shaft. Another incision 22, 32 is formed in respective retaining brackets 23 and 33. With the aid of these adjustment means, the printing-cylinder shaft is able to be disposed adjustably in U-shaped frames in a relatively simple manner parallel to the longitudinal axis thereof.

The retaining brackets 23 and 33 are provided, moreover, for supporting the ball bearings. The retaining brackets 23 and 33 are pivotally mounted and are connected by threaded fasteners to the legs 20 and 30 of the U-shaped frame. Thereby, in a relatively simple manner, the printing-cylinder shaft is releasable from the bearing system therefor and reinstallable without any readjustment.

The legs 20 and 30 are formed, on the sides thereof facing towards the open part of the frame, with fastening holes 24 and 34, respectively, through which a first rod 40, is slid and fixed in position by suitable threaded means, the first rod 40 serving to brace the legs 20 and 30. The rod 40 is connected, moreover, to a second rod 41 for carrying plates 50 to 54 which are formed with guide holes corresponding to the fastening holes 24, 34 formed in the legs 20, 30 of the frame. The plates 50 to 54 are, furthermore, formed with a partially annular shape at the sides thereof facing into the interior of the frame in the pivoted position thereof. These plates 50 to 54 serve to accommodate non-illustrated stepping motors for adjusting the printing rolls and printing cylinders and for accommodating the structural elements or components of the control devices for the adjusted printing values. For example, the components or structural elements for adjustment control are disposed between the plates 50 and 51, while the stepping motors are located between the plates 52 to 54. The two subassemblies thereby produced are pre-adjusted and, thereafter, connected by means of the first rod 40. Each individual subassembly is accordingly mounted so as to be pivotable or swingable with respect to the printing-cylinder shaft.

Respective spacer tubes or sleeves 42 and 43 of varying length are set on the rods 40 and 41, and correspond to the mutual spacings of the individual plates 50 to 54 as well as the spacings between the outer plates 50 and 54 and the respective legs 20 and 30 of the frame. The subassemblies on the plates 50 to 54 are thereby fixed in position thereof with respect to the printing-cylinder shaft.

The lead-through of the second rod 41 through the plates 50 to 54 has the effect that the latter are pivotable or swingable in common and that, due to the spacer sleeves 43, greater strength and stability of the subassemblies are achieved. The second rod 41 is suspended from and threadedly secured in guide holes or cut-outs 25 and 35 formed in the respective legs 20 and 30 of the frame. After a single fine adjustment of the stepping motors and the structural elements or components of the adjustment control device, the subassemblies on the plates 50 to 54 have unlimited pivotability or swingability.

There are claimed:

1. Chassis for postage metering machines having a printing-cylinder shaft supported by ball bearings, comprising a base plate, a U-shaped frame carried by said base plate and formed with two similarly shaped one-piece legs and a cross piece inter-connecting said legs, the U-shaped frame having a side closed by said cross piece and an open side opposite said closed side, one-piece retaining brackets fastened to said legs at each end of said retaining brackets and pivotable about one of said ends, said legs and brackets together having holes formed therein for completely surrounding the printing-cylinder shaft and for accommodating the ball bearings of the printing-cylinder shaft, a peripheral edge defining said holes in said legs and brackets being formed with blind incisions elongated in different directions for receiving therein means for vertically and horizontally adjusting the ball bearings in said holes, a first rod connecting said legs to one another across said open side of the U-shaped frame for mutually bracing said legs, a plurality of plates spaced along the length of said first rod and extending from one of said legs to the other and serving as carrying elements for subassemblies, said plates being supported for rotation by said first rod a second rod, carried by said plates, and pivotable into and out of said frame together with said plates about said first rod, and spacer sleeves intermediate adjacent ones of said plates being coaxially mounted on each of said rods for fixing said plates in mutually spaced relationship.

2. Chassis according to claim 1 wherein said second rod is removable from said plates so that said plates and the subassemblies carried thereby are individually pivotable with respect to said frame about said first rod.

3. Chassis according to claim 2 wherein said plates are formed with a partially annular shape at the sides thereof facing into the interior of the frame, when said plates are pivoted into said frame.

4. Chassis according to claim 1 wherein said plates are formed with a partially annular shape at the sides thereof facing into the interior of the frame, when said plates are pivoted into said frame.

* * * * *